US006601550B2

(12) United States Patent
Geyer et al.

(10) Patent No.: US 6,601,550 B2
(45) Date of Patent: Aug. 5, 2003

(54) METHOD FOR OPERATING A TWO-STROKE ENGINE

(75) Inventors: Klaus Geyer, Sulzbach (DE); Heiko Rosskamp, Adelberg (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/014,347

(22) Filed: Dec. 14, 2001

(65) Prior Publication Data

US 2002/0073943 A1 Jun. 20, 2002

(30) Foreign Application Priority Data

Dec. 18, 2000 (DE) ..... 100 63 042

(51) Int. Cl.[7] ..... F02B 33/04

(52) U.S. Cl. ..... 123/73 PP; 123/73 C; 123/73 A

(58) Field of Search ..... 123/73 A, 73 BA, 123/73 PP, 73 C

(56) References Cited

U.S. PATENT DOCUMENTS 4,286,553 A * 9/1981 Baltz et al. ..... 123/73 PP

FOREIGN PATENT DOCUMENTS

WO WO 00/55488 9/2000

* cited by examiner

*Primary Examiner*—Noah P. Kamen
(74) *Attorney, Agent, or Firm*—Walter Ottesen

(57) ABSTRACT

The invention is directed to a method for operating a two-stroke engine in a portable handheld work apparatus. The engine includes a cylinder (12) and a combustion chamber (26) which is delimited by a reciprocating piston (14). The combustion chamber includes an outlet (28) discharging exhaust gases and an inlet (30) of a storage channel (34). The inlet (30) lies approximately opposite the outlet (28) and the other end of storage channel (34) opens via a controlled end (38) into the crankcase (18). Between its ends, the storage channel (34) is connected to a first fuel metering device (20) of a first fuel path; whereas, the crankcase (18) has a crankcase inlet (24) which is connected to a second fuel metering device (19) of a second fuel path. In the case of an acceleration, additional fuel is metered to one or both fuel paths via an acceleration unit (22). In order to ensure a powerful run-up of the engine in the case of acceleration, the acceleration device (22) pumps into both fuel paths for an acceleration of the engine.

10 Claims, 3 Drawing Sheets

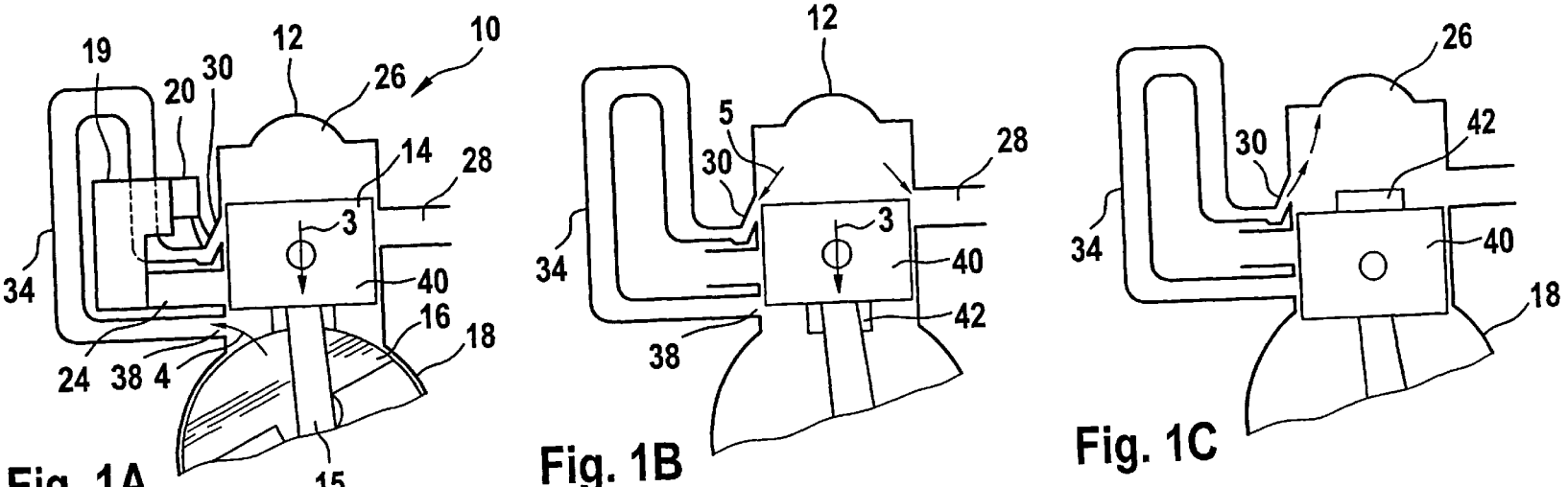
Fig. 1A
Fig. 1B
Fig. 1C
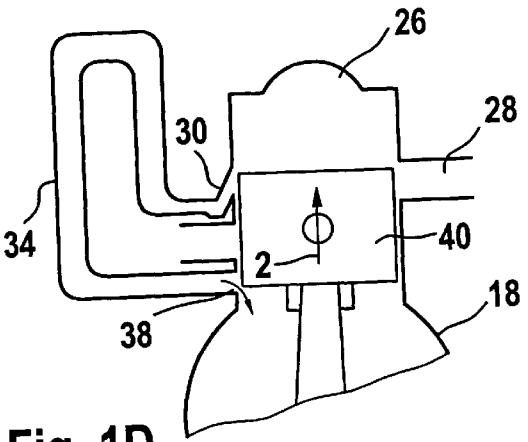
Fig. 1D
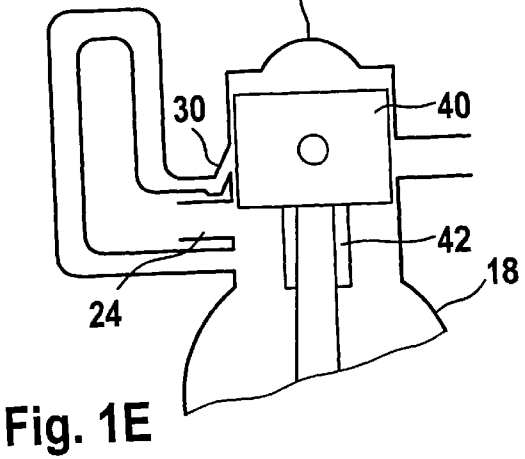
Fig. 1E

METHOD FOR OPERATING A TWO-STROKE ENGINE

BACKGROUND OF THE INVENTION

The invention relates to a method for operating a two-stroke engine as disclosed, for example, in published international patent application WO 00/55488.

The two-stroke engine disclosed in the above-identified publication includes two fuel paths. One of the fuel paths opens into the crankcase, whereas the other fuel path feeds into a storage channel. The distribution is so provided that, at idle, fuel is supplied in large part by the crankcase; whereas, at full load, essentially the entire fuel flows in via the storage channel. This allocation of fuel leads to an advantageous balanced operating performance with excellent exhaust-gas values but it has been determined that there is a poor run-up of the engine during accelerations.

SUMMARY OF THE INVENTION

It is an object of the invention to provide a method of the type described above which is so improved that a powerful acceleration of the engine is ensured.

The method of the invention is for operating a two-stroke engine including a drive motor in a portable, handheld work apparatus including a chain saw, a brushcutter and a cutoff machine. The engine includes: a cylinder having a cylinder wall; a piston mounted in the cylinder to undergo a reciprocating movement along a stroke path between top dead center and bottom dead center during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; an exhaust outlet for conducting exhaust gases away from the combustion chamber; a storage channel having a first end in the form of an inlet into the combustion chamber and the inlet lying approximately opposite to the exhaust outlet; the storage channel having a second end communicating via a controlled opening with the crankcase; a first fuel metering device connected to the storage channel between the first and second ends thereof; the first fuel metering device and the storage channel conjointly defining a first fuel path; the crankcase having a crankcase inlet; a second fuel metering device connected to the crankcase inlet and defining a second fuel path therewith; a transfer channel connected between the crankcase and the combustion chamber; the method comprising the steps of: providing an acceleration unit operatively connected to the first and second fuel paths; and, causing the acceleration unit to pump additional fuel into each of the first and second fuel paths during an acceleration of the engine.

It has been determined that the otherwise undertaken distribution of the fuel supply in the case of an acceleration is to be overcontrolled at least for a time in order to convey an additional quantity of fuel into each of the two fuel paths. This ensures a disturbance-free run-up of the engine in the case of acceleration.

It is practical during acceleration to pump approximately 30% to 60%, especially approximately 40%, of the additional fuel quantity to be supplied into the crankcase path. A greater part of the fuel is thereby supplied via the transfer channel and ensures an excellent charge of the combustion chamber.

In an advantageous further embodiment of the invention, the storage channel path is connected to the crankcase path via the idle chamber of a carburetor mounted in the crankcase path. The carburetor is especially a membrane carburetor. The acceleration unit pumps into the idle chamber in order to raise the fuel quantity in the storage channel.

The acceleration unit can be driven by the pressure difference between the crankcase and the control chamber of the carburetor. A configuration of the acceleration unit as a pump, which is controlled by the crankcase pressure, is advantageous.

BRIEF DESCRIPTION OF THE DRAWINGS

The invention will now be described with reference to the drawings wherein:

FIGS. 1A to 1E are schematics showing the operation of a two-stroke engine;

DESCRIPTION OF THE PREFERRED EMBODIMENTS OF THE INVENTION

Figure 2:
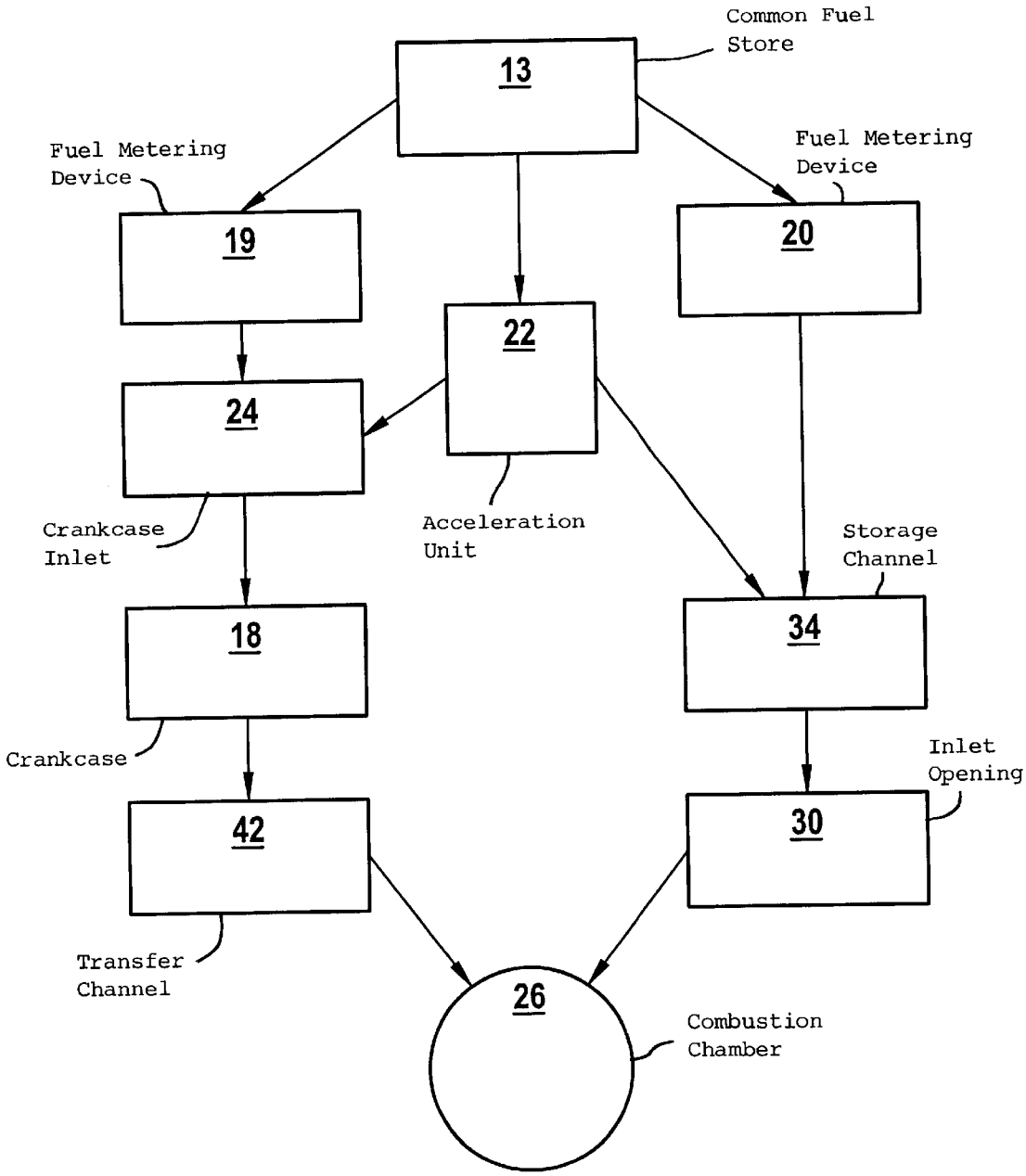
FIG. 2 is a flow diagram showing the fuel supply to the combustion chamber of the engine during operation thereof; and, FIG. 3 is a schematic showing the fuel supply for an engine having a carburetor.

The two stroke engine 10 shown in FIGS. 1A to 1E is especially a drive motor which can be utilized in a portable handheld work apparatus including a motor-driven chain saw, a brushcutter, a cutoff machine, a blower, et cetera. The engine includes a cylinder 12 having a combustion chamber 26 which is delimited by a piston 14. The piston 14 drives a crankshaft 16 via a connecting rod 15 and the crankshaft is rotatably journalled in a crankcase 18.

The combustion chamber 26 includes an outlet 28 for discharging exhaust gas. An inlet 30 of a storage channel 34 is provided approximately opposite to the outlet 28. The second end of the storage channel 34 opens via a controlled opening 38 into the crankcase 18.

In the cylinder 12, there is further a crankcase inlet 24 which is controlled by the piston skirt 40 of the piston 14 in the same manner as the inlet 30 as well as the opening 38 of the storage channel and the outlet 28.

An air/fuel mixture is to be supplied to the combustion chamber 26 for operating the internal combustion engine and this takes place via fuel metering devices 19 and 20. The fuel metering device 19 feeds the crankcase inlet 24. The fuel metering device 20 communicates with the storage channel 34 and the fuel metering device 20 is connected advantageously to the storage channel 34 near the inlet 30.

When the piston 14 travels out of the top dead center position in the direction of arrow 3 downwardly, then the mixture, which is drawn by suction into the crankcase 18, is compressed and, in part, passes into the storage channel 34 in the direction of arrow 4. With a further downward movement in the direction of arrow 3, the outlet 28 and the inlet 30 of the storage channel 34 are opened, preferably approximately simultaneously. The exhaust gases can flow off via the outlet 28. An exhaust-gas pressure wave passes through the inlet 30 into the storage channel 34 in the direction of arrow 5.

In the region of bottom dead center (FIG. 1C), the piston skirt 40 closes the opening 38 of the storage channel 34, which opening faces toward the crankcase 18, so that the exhaust-gas pressure wave, which enters in the direction of arrow 5, is reflected at the piston skirt 40 and this exhaust-gas pressure wave pushes the mixture, which is prestored in the storage channel 34, through the opening 30 and into the combustion chamber 26. The mixture, which is drawn by suction and is compressed in the crankcase 18, flows via the transfer channel 42 into the combustion chamber 26 and ensures a complete filling of the combustion chamber while simultaneously displacing the residual gases.

If the piston again travels in the direction of top dead center in the direction of arrow 2 (FIG. 1D), then the outlet 28 and the inlet 30 of the storage channel 34 are first closed and the mixture present in the combustion chamber 26 is compressed.

During the stroke movement in the direction of arrow 2, the piston skirt 40 clears the opening 38 of the storage channel so that the storage channel is relieved of pressure in the direction toward the crankcase 18. The opening 38 opens into the crankcase 18. Because of the upwardly traveling piston and because of the underpressure which increases in the crankcase 18, fuel or the air/fuel mixture is drawn by suction via the storage channel 34 and the first metering device 20 into the storage channel 34.

Only when the piston skirt 40 clears the inlet 24 as shown in FIG. 1E, fuel or an air/fuel mixture enters into the crankcase 18 via the second fuel metering device 19. After the ignition, the piston again travels downwardly in the direction of arrow 3 as shown in FIG. 1A and the cycles repeat as described above.

Figure 3:
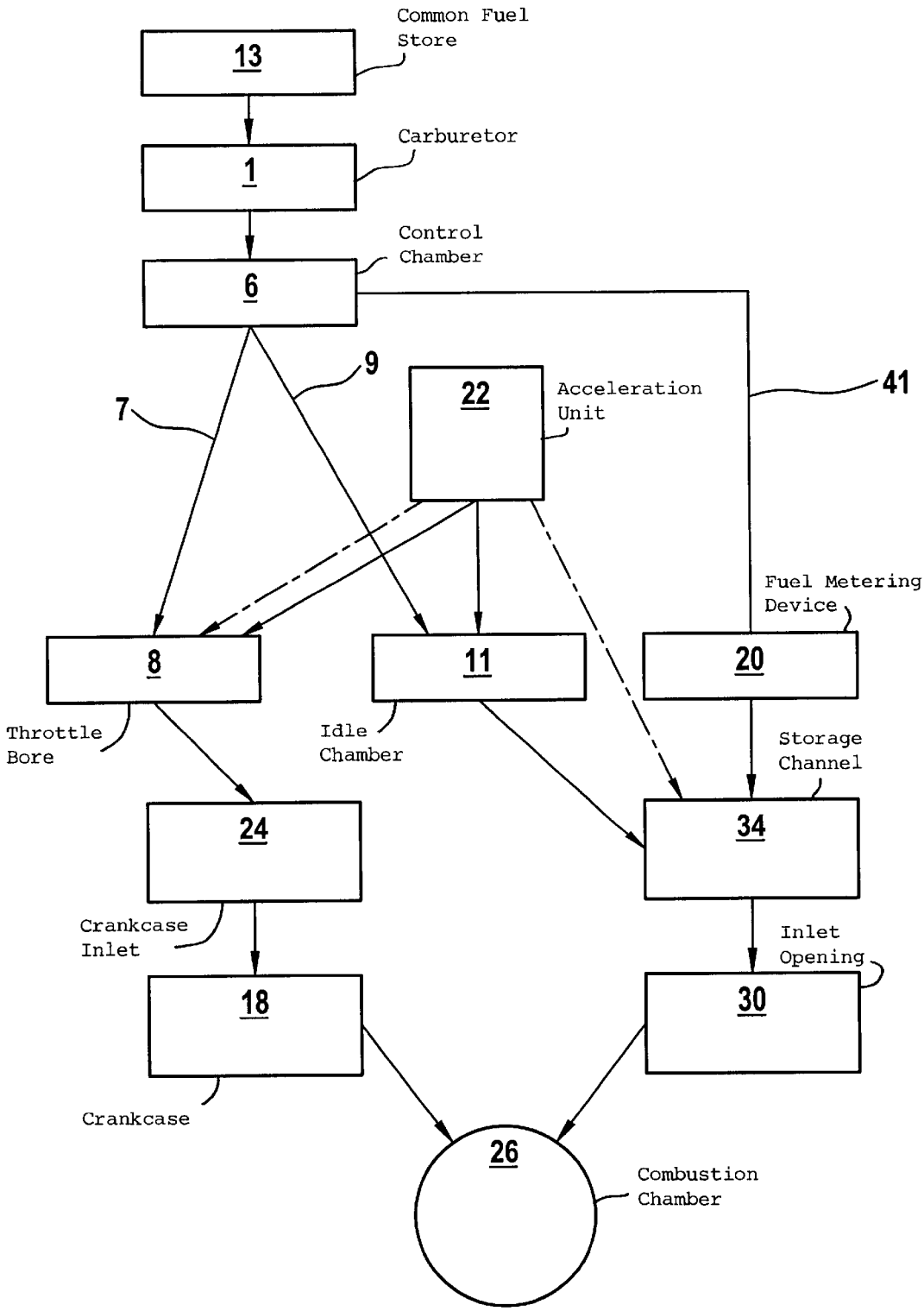

In order to ensure a disturbance-free powerful run-up during acceleration of the engine, additional fuel is pumped into the fuel path of the first fuel metering device 20 as well as into the fuel path of the second fuel metering device 19 via an acceleration unit (FIGS. 2 and 3). Here, the quantity of the additional fuel to be pumped is so dimensioned that 30% to 60%, especially approximately 40%, of the additional fuel quantity to be metered is pumped into the crankcase path, that is, made available to the engine 10 via the second metering device 19.

As shown schematically in FIG. 2, an acceleration unit 22 can supply fuel into the crankcase inlet 24 and into the storage channel 34 in addition to the fuel metering devices (19, 20). The supplied fuel quantity is increased in both fuel paths during an acceleration. The entry of the increased fuel quantity into the combustion chamber 26 takes place as described with respect to FIGS. 1A to 1E via the inlet opening 30 of the storage channel 34 and/or via the transfer channel 42. Here, both fuel metering devices 19 and 20 can be fed from a common fuel store 13 as indicated schematically in FIG. 2.

The acceleration unit can be a pump controlled preferably by the crankcase pressure.

In a further embodiment of the invention, a carburetor 1 is provided as a fuel metering device and the carburetor is preferably configured as a membrane carburetor. Membrane carburetors of this kind are generally known and have a control chamber 6 which is connected to an idle chamber 11 via a main valve path 7, a throttle bore or throttle path 8 and an ancillary nozzle path 9. The throttle bore 8 and the idle chamber 11 open into the crankcase inlet 24 of the crankcase 18. The mixture, which is drawn by suction into the crankcase 18, flows into the combustion chamber 26 via the transfer channel 42.

The additional fuel path to fuel metering device 20 of the storage channel 34 branches out of the control chamber 6 of the carburetor. The storage channel 34 opens into the combustion chamber 26 via the inlet opening 30 in a manner known per se. The additional fuel path 41 can be flow connected to the idle chamber 11 via a connection.

According to the invention, the acceleration unit 22 is configured in such a manner that, on the one hand, it pumps into the idle chamber 11 and therefore via the flow connection also into the storage channel 34 and, on the other hand, it pumps into the throttle path 8 which directly feeds into the combustion chamber 26 via the crankcase inlet 24. In this way, the acceleration unit 22 acts on the crankcase path as well as on the storage channel path with respect to fuel metering.

As an alternative, it can be provided that the acceleration pump 22 is connected directly to the throttle bore 8 or to the storage channel 34, that is, to the Venturi 20 so that a direct fuel metering is provided into the crankcase path as well as into the storage channel path. For this purpose, the acceleration unit is so provided that, during acceleration, 30% to 60%, especially approximately 40% of the additional fuel quantity, which is to be supplied, is metered via the crankcase path, that is, via the crankcase 24 and the transfer channel 42.

The pressure difference between the crankcase 18 and the control chamber 6 of the carburetor 1 can be advantageously utilized to drive the acceleration unit 22.

It is understood that the foregoing description is that of the preferred embodiments of the invention and that various changes and modifications may be made thereto without departing from the spirit and scope of the invention as defined in the appended claims.

What is claimed is:

1. A method for operating a two-stroke engine including a drive motor in a portable, handheld work apparatus including a chain saw, a brushcutter and a cutoff machine, the engine including: a cylinder having a cylinder wall; a piston mounted in said cylinder to undergo a reciprocating movement along a stroke path between top dead center and bottom dead center during operation of said engine; said cylinder and said piston conjointly delimiting a combustion chamber; a crankcase connected to said cylinder; a crankshaft rotatably mounted in said crankcase; a connecting rod connecting said piston to said crankshaft to permit said piston to drive said crankshaft as said piston reciprocates in said cylinder; an exhaust outlet for conducting exhaust gases away from said combustion chamber; a storage channel having a first end in the form of an inlet into said combustion chamber and said inlet lying approximately opposite to said exhaust outlet; said storage channel having a second end communicating via a controlled opening with said crankcase; a first fuel metering device connected to said storage channel between said first and second ends thereof; said first fuel metering device and said storage channel conjointly defining a first fuel path; said crankcase having a crankcase inlet; a second fuel metering device connected to said crankcase inlet and defining a second fuel path therewith; a transfer channel connected between said crankcase and said combustion chamber; the method comprising the steps of:

providing an acceleration unit operatively connected to said first and second fuel paths; and, causing said acceleration unit to pump additional fuel into each of said first and second fuel paths during an acceleration of said engine.

2. The method of claim 1, wherein said acceleration unit pumps approximately 30% to 60% of the fuel quantity to be additionally metered into said second fuel path.

3. The method of claim 2, wherein said acceleration unit pumps approximately 40% of the fuel quantity to be additionally metered into said second fuel path.

4. The method of claim 1, comprising the further steps of:

providing a carburetor having an idle chamber and mounting said carburetor in said second fuel path;

connecting said storage channel to said second fuel path via said idle chamber; and, causing said acceleration unit to pump into said idle chamber.

5. The method of claim 4, wherein said carburetor is a membrane carburetor.

6. The method of claim 4, wherein said acceleration unit is driven by the pressure difference between the crankcase and the control chamber of said carburetor.

7. The method of claim 1, wherein said acceleration unit is a pump.

8. The method of claim 7, wherein said pump is controlled by the pressure in said crankcase.

9. A method for operating a two-stroke engine including a drive motor in a portable, handheld work apparatus including a chain saw, a brushcutter and a cutoff machine, the engine including: a cylinder having a cylinder wall; a piston mounted in said cylinder to undergo a reciprocating movement along a stroke path between top dead center and bottom dead center during operation of said engine; said cylinder and said piston conjointly delimiting a combustion chamber; a crankcase connected to said cylinder; a crankshaft rotatably mounted in said crankcase; a connecting rod connecting said piston to said crankshaft to permit said piston to drive said crankshaft as said piston reciprocates in said cylinder; an exhaust outlet for conducting exhaust gases away from said combustion chamber; a storage channel having a first end in the form of an inlet into said combustion chamber and said inlet lying approximately opposite to said exhaust outlet; said storage channel having a second end communicating via a controlled opening with said crankcase; a first fuel metering device connected to said storage channel between said first and second ends thereof; said first fuel metering device and said storage channel conjointly defining a first fuel path; said crankcase having a crankcase inlet; a second fuel metering device connected to said crankcase inlet and defining a second fuel path therewith; a transfer channel connected between said crankcase and said combustion chamber; the method comprising the steps of:

providing an acceleration unit operatively connected to said second fuel path; and, causing said acceleration unit to pump additional fuel into said second fuel path during an acceleration of said engine.

10. The method of claim 9, wherein the entire fuel quantity for said acceleration is metered via said second fuel path.

* * * * *